US006203402B1

(12) United States Patent
Hildebrandt

(10) Patent No.: US 6,203,402 B1
(45) Date of Patent: Mar. 20, 2001

(54) DEVICE FOR FINISHING CURVED WORK PIECE SURFACES USING A GRINDING BELT

(75) Inventor: Oliver Hildebrandt, Gutach (DE)

(73) Assignee: Supfina Grieshaber GmbH & Co. KG, Bad Rippoldsau-Schapbach ( * ) Notice: Subject to any disclaimer, the term of this patent is extended or adjusted under 35 U.S.C. 154(b) by 0 days.

(21) Appl. No.: 09/567,895

(22) Filed: May 10, 2000

(30) Foreign Application Priority Data

May 15, 1999 (DE) ..... 199 22 477
Jun. 1, 1999 (DE) ..... 199 25 077

(51) Int. Cl.[7] ..... B24B 49/00
(52) U.S. Cl. ..... 451/8; 451/303; 451/310
(58) Field of Search ..... 451/8, 49, 6, 302, 451/303, 310, 168

(56) References Cited

U.S. PATENT DOCUMENTS 4,993,191 * 2/1991 Judge et al. ..... 51/154
5,095,663 * 3/1992 Judge et al. ..... 51/165.91
5,651,719 * 7/1997 Pineau ..... 451/8
5,683,291 * 11/1997 Humpert et al. ..... 451/168
5,984,767 * 11/1999 Pinaue et al. ..... 451/302
6,080,051 * 6/2000 Weber ..... 451/303

FOREIGN PATENT DOCUMENTS 690 09 890 9/1994 (DE) .
196 07 778 9/1997 (DE) .
196 50 155 6/1998 (DE) .
197 14 677 10/1998 (DE) .
197 38 818 3/1999 (DE) .

* cited by examiner

*Primary Examiner*—Timothy V. Eley
*Assistant Examiner*—Dung Van Nguyen

(57) ABSTRACT

The invention concerns a device for belt-grinding curved material surfaces, wherein the abrasive belt is pressed onto the surface of the work piece by means of two processing shoes and at the same time, the surface of the work piece to be processed is measured by an in-processing means.

19 Claims, 2 Drawing Sheets

40
42

40
42
40
42

42
40

DEVICE FOR FINISHING CURVED WORK PIECE SURFACES USING A GRINDING BELT

This application claims Paris Convention priority of DE 199 22 477.3 filed May 15, 1999 and DE 199 25 077.4 filed Jun. 1, 1999 the complete disclosure of which are hereby incorporated by reference.

BACKGROUND OF THE INVENTION

The invention concerns a device for belt-grinding curved work piece surfaces, comprising an acceptance device for the work piece, the acceptance device comprising means for turning the work piece and an oscillation means for oscillating the work piece in its axial direction, and with processing jaws with two processing arms, wherein each processing arm has, in the region of its free end, at least one processing shoe partially surrounding the work piece surface to be processed, and further comprising an abrasive belt extracted from a supply roller and guided between the processing shoes and the work piece surface to be processed and towards an extraction means.

Belt-grinding devices of this kind are well-known. Such devices are mainly used for finishing the bearing locations of crank shafts, cam shafts, gear shafts and connecting rod bearings on crank shafts. The bearings are post-treated after grinding using an abrasive belt, wherein the shape of the bearing and the roundness of the bearing are corrected to desired values. During super finishing, the abrasive belt is pressed onto the work piece surface by a processing shoe into which the processing shell has been inserted. The work piece is thereby turned and simultaneously reciprocated in the axial direction. The pressure is exerted by two processing shoes engaging the work piece, each pressing a portion of the abrasive belt onto the work piece. The processing time can be determined empirically with the work pieces being processed for an equal length of empirically determined time. This results in different processing results. Alternatively, e.g. the diameter of the work piece is measured during processing and processing is interrupted once a predetermined value has been reached. In processing devices of this kind having such an in-process measuring means, the work piece is processed from one side only, i.e. via a processing shoe, with the measuring device being disposed on the other side to carry out the measurement. Belt-grinding machines of this kind have the advantage of measuring processing development during the processing operation to permit an optimum finishing result. However, the processing time is considerably longer than with devices not having such in-process measuring means, due to the reduced surface area engagement of the belt.

It is therefore the underlying purpose of the invention to further develop a device of the above mentioned kind such that equally good processing results can be achieved with considerably reduced processing time.

SUMMARY OF THE INVENTION

This object is achieved in accordance with the invention in that a device of the above mentioned kind comprises an in-process measuring means for measuring, during processing, the work piece surface to be treated, the measuring means being disposed at the free end of one of the processing arms.

In the inventive belt-grinding device, the work piece is processed by two processing shoes and simultaneously measured during processing. This is possible by providing, in addition to the two processing shoes, an in-process measuring means which surrounds one of the two processing shoes. The in-process measuring means thereby surrounds the processing shoe directly in that plane in which the work piece is processed or measured. There is normally no space available next to the processing shoes, i.e. next to the work piece surfaces to be treated, since either other structural parts are disposed at this location or a further work piece surface to be treated is directly adjacent thereto. The in-process measuring means does not therefore surround the side of the processing shoe.

In a further development of the invention, the in-process measuring means is a measuring means for determining the diameter, the surface roughness, the conical slanting and/or crowning of the surface. In general, the diameter of the work piece section to be processed is measured, since it depends on the processing time. The conical slanting, surface roughness, crowning etc. are set through selection of the abrasive belt and the processing shoes or processing shells and optionally the bearing thereof.

In one embodiment, the in-process measuring means comprises at least two measuring probes, in particular, facing one another and having a DMS measuring bridge. The diameter of the work piece section to be processed is detected by seating these measuring probes on the surface to be processed. Evaluation of the measurement signals is carried out via a DMS bridge which is advantageously integrated into the in-process measuring means.

In another embodiment, the in-process measuring means is an optical, pneumatic or hydraulic measuring means. Measurement can be carried out e.g. by optical elements, such as a laser beam or the like, or using a fluid such as air or honing oil or the like. Pneumatic or hydraulic measuring means comprise measuring nozzles which guide the fluid to the surface to be processed or to a specially generated surface, and the back-pressure or flow is measured.

In a further development of the invention, the in-process measuring means is disposed on the processing arm associated with the supply roller. The processing shoe is thereby guided, together with the measuring means, to the work piece surface to be treated, or lifted therefrom through the closing or opening of the processing jaws. As soon as the measuring means detects the desired degree of processing, the closing pressure of the processing jaws is removed, wherein the two processing arms seat with low pressure on the work piece surface to be processed and are carried along therewith, e.g. at a crank pin. Opening of the processing arms is also possible for bearing locations without orbit.

In accordance with the invention, the processing shoes are provided with hard inserts and/or soft inserts e.g. made from vulkollan, an elastomer or the like. Appropriate combination of the inserts achieves optimum improvement of the cylindrical shape, the surface quality, the roughness or the reduction of conical slanting.

In a further embodiment, the processing shoes are provided with continuous area contact or slotted processing shells. Slotted processing shells, as disclosed in DE 44 44 239 A1, have the advantage that their encompassing diameter can be slightly altered to permit optimum adjustment to the diameter of the work piece section to be processed.

In a further embodiment, the processing shoes have rapid-exchange shells. Rapid-exchange shells of this kind are disclosed e.g. in DE 297 19 168 U1.

To guide the abrasive belt in the region of entrance into the processing shoe and in the region of exit from the processing shoe around or past the holding means of the measuring means in an as simple a manner as possible, the processing arm comprising the in-process measuring means has deflection means for the abrasive belt in the region of the processing shoe. These deflection means guide the abrasive belt, as mentioned above, in the processing plane past or through the holding arms for the probe arms or probe pins of the measuring means.

In a further development, the abrasive belt is turned or folded in its longitudinal direction by the deflection means through approximately 90°. By turning the abrasive belt through approximately 90°, it is directed parallel to the processing plane of the work piece or to the closing plane of the processing jaws and can therefore be introduced relatively easily into the processing region. At this location, the abrasive belt is turned back into the original position to enable flat abutment on the work piece surface to be treated. It is also possible to fold the abrasive belt so that it also extends parallel to the closing plane of the jaws. The side of the abrasive belt coated with grinding particles can thereby be folded toward the inside or outside.

The deflection means can thereby be formed as an opening which is circular, oval, rectangular, spiral, U-shaped and/or which is open at the edges. Moreover, the opening can rotate along its length. The abrasive belt is turned or folded by this opening, through which it is guided. The abrasive belt can be inserted into the opening in a simple manner through a recess having open edges as, in particular, required when replacing the belt.

The deflection means are preferably disposed at the free end of the processing shoe or the processing shell. This means that the belt is turned or folded through 90° at the probe arms of the in-process measuring means and returned to its original position directly after the probe arm. This is effected at entrance into and exit from the processing shell.

Further advantages, features and details of the invention can be extracted from the dependent claims and the following detailed description of a particularly preferred embodiment with reference to the drawing. The features shown in the drawing and mentioned in the description and in the claims may be essential to the invention either individually or collectively in any arbitrary combination.

DESCRIPTION OF THE PREFERRED EMBODIMENT

Figure 1:
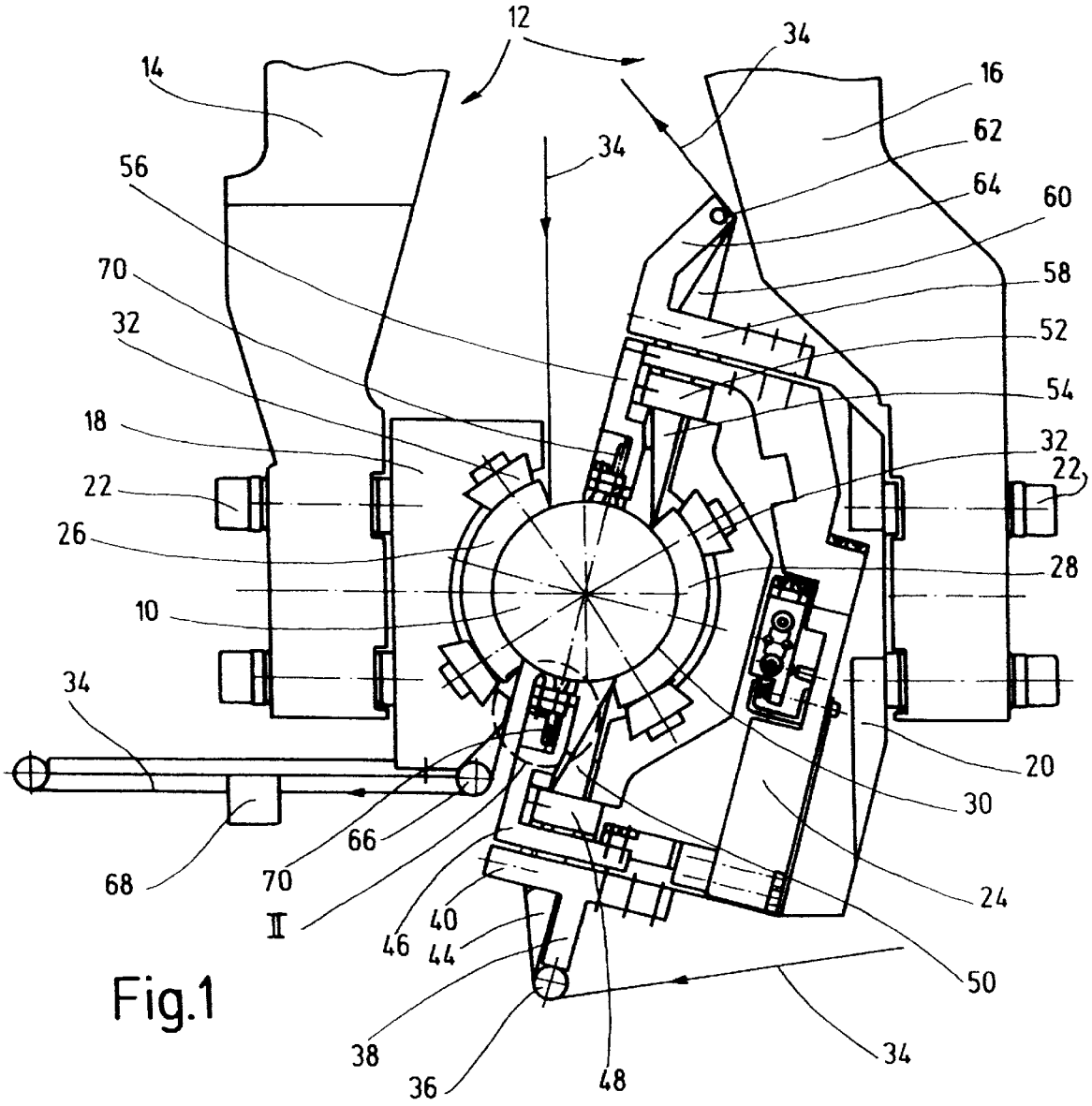
FIG. 1 is a side view of the free ends of processing jaws surrounding a tool to be processed.

FIG. 1 is a broken-off view of jaws, designated in their entirety with 12, of a device for belt-grinding work pieces 10, wherein the processing jaws 12 comprise a first processing arm 14 and a second processing arm 16. Processing shoes 18 and 20 are mounted to the free ends of the two processing arms 14 and 16 by fastening screws 22. The processing shoe 20 also receives an in-process measuring means referred to in its entirety with 24.

Figures 3A, 3B, 3C, 3D:
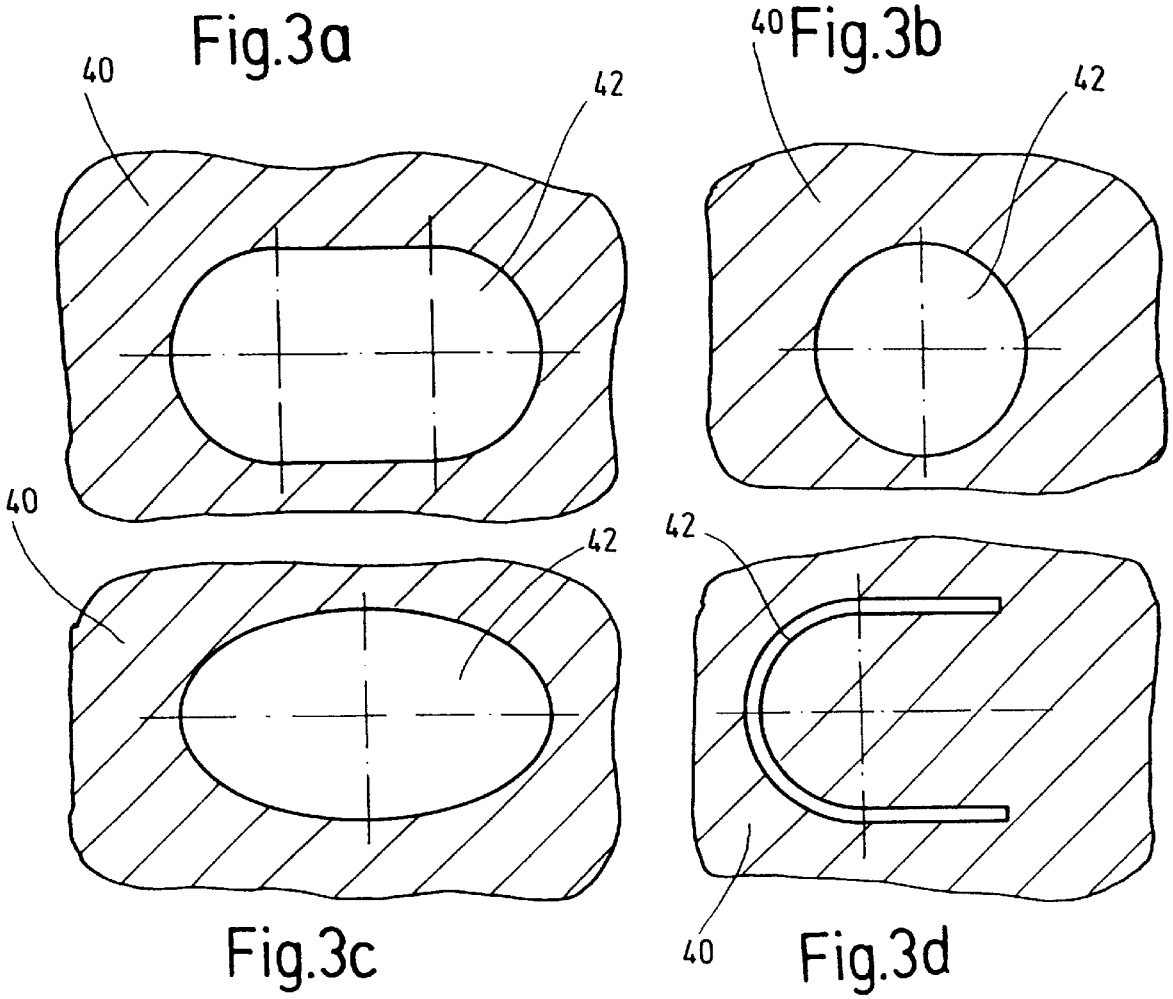
FIG. 3*a* shows a first embodiment of an opening for the abrasive belt.
FIG. 3*b* shows a second embodiment of an opening for the abrasive belt.
FIG. 3*c* shows a third embodiment of an opening for the abrasive belt.
FIG. 3*d* shows a fourth embodiment of an opening for the abrasive belt.

The free ends of the two processing arms 14 and 16 surround the work piece 10 and seat, with processing shells 26 and 28, on the surface 30 of the work piece 10 to be treated. The processing shells 26 and 28, which may also be slotted (wherein the slots extend parallel to the axial direction of the work piece 10), are supported by inserts 32. These inserts 32 can be made from a hard or soft material, e.g. vulkollan or an elastomer. The inserts 32 are anchored, e.g. via a dove-tailed groove, in the processing shoe 18 or 20. The processing shells 26 and 28 are supported by the inserts 32 and pressed onto the surface 30 of the work piece 10. An abrasive belt 34 is disposed between the two processing shoes 26 and 28 and the surface 30 of the work piece 10 to abrade material from the surface 30 of the work piece 10. This abrasive belt 34 is extracted from a supply roller (not shown) and deflected via a first deflection roller 36 in the direction of the work piece 10. This deflection roller 36 is located on a lower belt guidance 38 mounted to the processing shoe 20. The belt guidance 38 has an opening 42 in a guiding section 40 which is shown in more detail in FIGS. 3*a* to 3*d*. The abrasive belt 34 is guided through this opening 42, wherein it is either turned or folded through 90° between the opening 42 and the deflection roller 36 in a section designated with 44. In the opening of FIG. 3*d*, the abrasive belt 34 is folded in a U-shaped manner. In this fashion, the dimension of the abrasive belt 34 is considerably reduced in the direction of the axis of the work piece 10, such that the abrasive belt 34 can be guided past the lower measuring insert 46 without any problems. This measuring insert 46 is either narrower than the guiding section 40 or comprises an opening corresponding to the opening 42. A further guiding section 48 is connected to the measuring insert 46 and is also provided with an opening corresponding to the opening 42. At this location, the abrasive belt is guided back into its original orientation in a section 50. In this fashion, the abrasive belt 34, whose width is generally similar to that of the guiding section 40 or 48 or of the measuring insert 46, can be guided past or through these elements. The opening 42 of FIG. 3*d* is exemplary only. The two legs of the U-shaped opening may be closer to each another.

The upper end of the processing shoe 20 is also provided with a belt guidance 64 comprising a guiding section 52 with an opening 42 in which the abrasive belt 34 is curved or folded through 90° via a section 54. In this manner, the abrasive belt 34 can bypass or be guided through the upper measuring insert 56. This measurement insert 56 is followed by a further guiding section 58 also having an opening so that the abrasive belt 34 is returned to its original position in a section 60. The abrasive belt 34 is then guided towards the pivot axis of the processing jaws 12 via a further deflection roller 62 mounted to the belt guidance 64. After the abrasive belt 34 is deflected at that location, it enters between the processing shell 26 and the work piece 10 and is extracted via a deflection roller 66 and a belt guidance 68.

The shaping of the abrasive belt 34 in the region of the measuring inserts 46 and 56 permits the abrasive belt to be pressed onto the surface 30 of the work piece 10 not only between the processing shell 26 and the work piece 10 but also between the processing shell 28 and the work piece 10. The processing time is considerably reduced due to the considerably larger application area of the abrasive belt.

Figure 2:
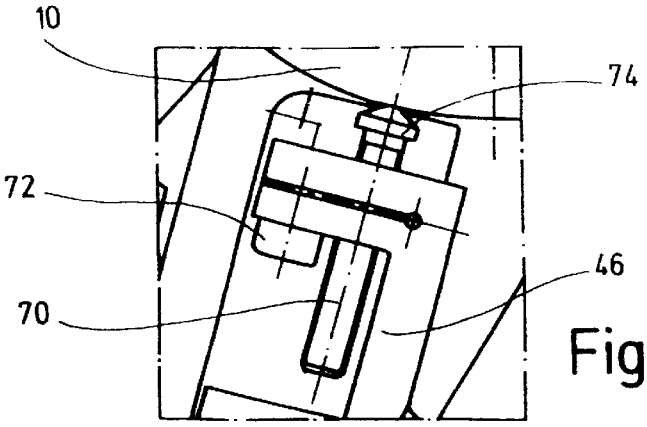
FIG. 2 shows a section II in accordance with FIG. 1, of a probe finger of the in-process measuring means.

During processing of the work piece 10, its diameter is measured by the in-process measuring means 24 by supporting two measuring tips 70 at opposing locations on the surface 30 of the work piece 10. These measuring tips 70 are mounted to each measuring insert 46 and 56. FIG. 2 shows an enlarged view of such an acceptance device in the measuring tip 70 on the measuring insert 46. The measuring insert 46 is slotted at its free end and receives the measuring tip 70. The measuring tip 70 is held in a non-rotatable manner via a clamping screw 72. For adjusting the position of the measuring tip 70 in the measuring insert 46, the measuring tip 70 is screwed, at a hexagonal head 74, to an appropriate extent into the receiving bore of the free end of the measuring insert 46 and then secured via the clamping screw 72. The same is true for the measuring insert 56.

The work pieces 10 can therefore be processed more quickly, wherein the processing quality can still be monitored via the in-process measuring means 24.

I claim:

1. A device for belt-grinding a treating work piece surface of a curved work piece using a grinding belt extracted from a supply roller, passed along the work piece surface, and extracted by an extraction roller, the device comprising:

means for holding, turning and reciprocating the work piece in an axial direction thereof;

a first processing arm extending toward the work piece and proximate to a first side of the work piece at a first arm end;

a second processing arm extending toward the work piece and proximate to a second side of the work piece, opposite to the first side of the work piece, at a second arm end;

a first processing shell mounted to said first arm end and partially surrounding the first work piece side to press the grinding belt against the work piece surface;

a second processing shell mounted to said second arm and partially surrounding the second work piece side to press the grinding belt against the work piece surface;

in-process measuring means for measuring the work piece surface during processing;

a first processing shoe disposed between said first processing arm and said first processing shell for mounting said first processing shell to said first processing arm; and a second processing shoe disposed between said second processing arm and said second processing shell for mounting said second processing shell to said second processing arm, wherein said in-process measuring means is disposed on one of said first and said second processing arms, wherein said processing arm on which said in-processing measuring means is disposed comprises deflection means for the abrasive belt in a region of a processing shoe of that processing arm.

2. The device of claim 1, wherein said in-process measuring means determines at least one of a diameter, a surface roughness, a conical slanting and a crowning of the work piece surface.

3. The device of claim 1, wherein said in-process measuring means comprises a first and a second measuring probe.

4. The device of claim 3, wherein said first measuring probe is disposed opposite to said second measuring probe.

5. The device of claim 3, further comprising a DMS measuring bridge.

6. The device of claim 1, wherein said in-process measuring means is one of an optical, a pneumatic and a hydraulic measuring means.

7. The device of claim 1, wherein said in-process measuring means is disposed on one of said first and said second processing arms.

8. The device of claim 1, wherein at least one of said first and said second processing shoes comprise a hard insert.

9. The device of claim 1, wherein at least one of said first and said second processing shoes comprise a soft insert.

10. The device of claim 9, wherein said soft insert is one of vulkollan and an elastomer.

11. The device of claim 1, wherein said first and said second processing shells are slotted.

12. The device of claim 1, wherein at least one of said first and said second processing shells are mounted to said processing shoes for rapid exchange.

13. The device of claim 1, wherein said deflection means turns the abrasive belt about its longitudinal direction through approximately 90°.

14. The device of claim 1, wherein said deflection means folds the abrasive belt about its longitudinal direction through approximately 90°.

15. The device of claim 1, wherein said deflection means have an opening through which the abrasive belt passes.

16. The device of claim 15, wherein the opening is one of circular, oval, rectangular, spiral, U-shaped and open at edges.

17. The device of claim 1, wherein said in-process measuring means comprises a probe arm and a measuring probe borne by said probe arm, wherein said deflection means are disposed proximate said probe arm.

18. The device of claim 1, wherein each deflection means is disposed on one of a free end of a processing shoe and a processing shell.

19. The device of claim 1, wherein said in-process measuring means is disposed proximate the abrasive belt.

* * * * *